US011131945B2

(12) United States Patent
Takazawa

(10) Patent No.: US 11,131,945 B2
(45) Date of Patent: Sep. 28, 2021

(54) BELT UNIT AND IMAGE FORMATION APPARATUS

(71) Applicant: Oki Data Corporation, Tokyo (JP)

(72) Inventor: Takayuki Takazawa, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 16/995,758

(22) Filed: Aug. 17, 2020

(65) Prior Publication Data

US 2021/0063918 A1 Mar. 4, 2021

(30) Foreign Application Priority Data

Aug. 30, 2019 (JP) ..... JP2019-157596

(51) Int. Cl.
*G03G 15/16* (2006.01)

(52) U.S. Cl.
CPC ..... *G03G 15/162* (2013.01); *G03G 15/1615* (2013.01); *G03G 2215/1623* (2013.01)

(58) Field of Classification Search
CPC ..... G03G 15/162; G03G 2215/1623
See application file for complete search history.

(56) References Cited

U.S. PATENT DOCUMENTS

2009/0148201 A1* 6/2009 Sawai ..... G03G 15/162 399/302
2012/0315067 A1* 12/2012 Takahashi ..... G03G 15/162 399/302
2014/0178111 A1* 6/2014 Iida ..... G03G 15/162 399/302
2014/0341620 A1* 11/2014 Yoshioka ..... G03G 15/1675 399/313
2017/0242372 A1* 8/2017 Omori ..... G03G 15/162

FOREIGN PATENT DOCUMENTS

JP 2015-102601 A 6/2015

* cited by examiner

*Primary Examiner* — Carla J Therrien
(74) *Attorney, Agent, or Firm* — Metrolex IP Law Group, PLLC

(57) ABSTRACT

A belt unit according to an embodiment may include: an endless belt including a first surface and a second surface opposite to the first surface; and a drive roller in contact with the second surface and configured to drive the endless belt. A surface potential of the first surface of the belt is a voltage of not more than 20 volts, 0.1 seconds after an application of a voltage of 6000 volts.

16 Claims, 10 Drawing Sheets

| | SURFACE RESISTIVITY [logΩ/□] | | Δρs | SURFACE POTENTIAL [V] | | SECONDARY TRANSFER EFFICIENCY | | | LEVEL OF TRANSFER STREAKS | |
|---|---|---|---|---|---|---|---|---|---|---|
| | | | | $V_0$ | $V_1$ | | | | | |
| | ρs1 OUTER | ρs2 INNER | ρs1-ρs2 | 0.1s | 0.5s | PEAK VALUE | CURRENT DEPENDENCE (ABS) | VALUE AT EXECUTION CURRENT OF 50μA | | |
| EXAMPLE 1 | 9.5 | 9.5 | -0.09 | 13 | 4 | 94 | 0.05 | 92 | 1 | × |
| EXAMPLE 2 | 10.0 | 10.0 | -0.04 | 17 | 10 | 93 | 0.10 | 89 | 2 | ▲ |
| EXAMPLE 3 | 10.4 | 10.4 | 0.03 | 22 | 12 | 93 | 0.13 | 88 | 3 | ◆ |
| EXAMPLE 4 | 10.9 | 11.0 | -0.08 | 38 | 19 | 94 | 0.17 | 87 | 4 | ● |
| EXAMPLE 5 | 11.3 | 11.3 | -0.04 | 43 | 24 | 94 | 0.19 | 86 | 4 | ● |
| EXAMPLE 6 | 11.8 | 11.9 | -0.05 | 52 | 34 | 95 | 0.24 | 85 | 2 | ▲ |

FIG. 3

| | SURFACE RESISTIVITY [logΩ/□] | | Δρs | SURFACE POTENTIAL [V] | | SECONDARY TRANSFER EFFICIENCY | | | LEVEL OF TRANSFER STREAKS | |
|---|---|---|---|---|---|---|---|---|---|---|
| | | | | $V_0$ | $V_1$ | | | | | |
| | ρs1 OUTER | ρs2 INNER | ρs1-ρs2 | 0.1s | 0.5s | PEAK VALUE | CURRENT DEPENDENCE (ABS) | VALUE AT EXECUTION CURRENT OF 50μA | | |
| EXAMPLE 1 | 9.5 | 9.5 | -0.09 | 13 | 4 | 94 | 0.05 | 92 | 1 | × |
| EXAMPLE 2 | 10.0 | 10.0 | -0.04 | 17 | 10 | 93 | 0.10 | 89 | 2 | ▲ |
| EXAMPLE 3 | 10.4 | 10.4 | 0.03 | 22 | 12 | 93 | 0.13 | 88 | 3 | ◆ |
| EXAMPLE 4 | 10.9 | 11.0 | -0.08 | 38 | 19 | 94 | 0.17 | 87 | 4 | ● |
| EXAMPLE 5 | 11.3 | 11.3 | -0.04 | 43 | 24 | 94 | 0.19 | 86 | 4 | ● |
| EXAMPLE 6 | 11.8 | 11.9 | -0.05 | 52 | 34 | 95 | 0.24 | 85 | 2 | ▲ |

FIG. 7

| | SURFACE RESISTIVITY [logΩ/□] | | Δρs | SURFACE POTENTIAL [V] | | SECONDARY TRANSFER EFFICIENCY | | | LEVEL OF TRANSFER STREAKS | |
|---|---|---|---|---|---|---|---|---|---|---|
| | | | | $V_0$ | $V_1$ | | | | | |
| | ρs1 OUTER | ρs2 INNER | ρs1-ρs2 | 0.1s | 0.5s | PEAK VALUE | CURRENT DEPENDENCE (ABS) | VALUE AT EXECUTION CURRENT OF 50μA | | |
| EXAMPLE 1 | 9.5 | 9.5 | -0.09 | 13 | 4 | 94 | 0.05 | 92 | 1 | × |
| EXAMPLE 2 | 10.0 | 10.0 | -0.04 | 17 | 10 | 93 | 0.10 | 89 | 2 | ▲ |
| EXAMPLE 3 | 10.4 | 10.4 | 0.03 | 22 | 12 | 93 | 0.13 | 88 | 3 | ◆ |
| EXAMPLE 4 | 10.9 | 11.0 | -0.08 | 38 | 19 | 94 | 0.17 | 87 | 4 | ● |
| EXAMPLE 5 | 11.3 | 11.3 | -0.04 | 43 | 24 | 94 | 0.19 | 86 | 4 | ● |
| EXAMPLE 6 | 11.8 | 11.9 | -0.05 | 52 | 34 | 95 | 0.24 | 85 | 2 | ▲ |
| EXAMPLE 7 | 9.4 | 9.8 | -0.40 | 6 | 6 | 92 | 0.05 | 90 | 1 | × |
| EXAMPLE 8 | 10.1 | 10.0 | 0.10 | 9 | 4 | 92 | 0.05 | 90 | 3 | ● |
| EXAMPLE 9 | 10.0 | 10.0 | 0.02 | 10 | 6 | 93 | 0.06 | 90 | 4 | ◆ |
| EXAMPLE 10 | 10.2 | 9.9 | 0.30 | 11 | 6 | 94 | 0.06 | 92 | 4 | ● |
| EXAMPLE 11 | 10.7 | 10.5 | 0.24 | 12 | 6 | 94 | 0.07 | 91 | 4 | ● |
| EXAMPLE 12 | 10.5 | 10.1 | 0.40 | 11 | 6 | 94 | 0.06 | 92 | 3 | ◆ |
| EXAMPLE 13 | 11.4 | 11.3 | 0.12 | 11 | 7 | 93 | 0.05 | 91 | 4 | ● |
| EXAMPLE 14 | 11.6 | 11.3 | 0.30 | 12 | 5 | 94 | 0.06 | 92 | 4 | ● |

BELT UNIT AND IMAGE FORMATION APPARATUS

CROSS REFERENCE TO RELATED APPLICATIONS

This application claims priority based on 35 USC 119 from prior Japanese Patent Application No. 2019-157596 filed on Aug. 30, 2019, entitled "BELT UNIT AND IMAGE FORMATION APPARATUS", the entire contents of which are incorporated herein by reference.

BACKGROUND

The disclosure relates to a belt unit and an image formation apparatus.

In a related art, as an image formation apparatus such as a copy machine, a printer, a multi-function machine, or the like, there is an image formation apparatus of an intermediate transfer type. Such an intermediate transfer image formation apparatus forms an electrostatic latent image by uniformly charging a surface of a photosensitive drum and exposing an image on the charged surface of the photosensitive, supplies toner from a development device to the electrostatic latent image to form a toner image, primarily transfers the toner image to an intermediate transfer belt, secondarily transfers primarily transferred toner image from the intermediate transfer belt to a recording medium, and fixes the toner image transferred to the recording medium to the recording medium.

In the related art, an image formation apparatus may use an intermediate transfer belt made of a single layer of resin, for example, as described in Patent Document 1.

Patent Document 1: Japanese Patent Application Publication No. 2015-102601

SUMMARY

However, in the related art, it may be difficult to stabilize image quality in various environments.

An object of an embodiment of the disclosure is to stabilize image quality in various environments.

An aspect of the disclosure may be a belt unit that may include: an endless belt including a first surface and a second surface opposite to the first surface; and a drive roller in contact with the second surface and configured to drive the endless belt. A surface potential of the first surface of the belt is a voltage of not more than 20 volts, 0.1 seconds after an application of a voltage of 6000 volts.

According to the aspect, image quality can be stabilized in various environments.

BRIEF DESCRIPTION OF DRAWINGS

FIG. 3 is a diagram illustrating a table indicating measuring results according to Embodiment 1.

FIG. 7 is a diagram illustrating a table indicating evaluation results of Embodiment 2.

DETAILED DESCRIPTION

Figure 1:
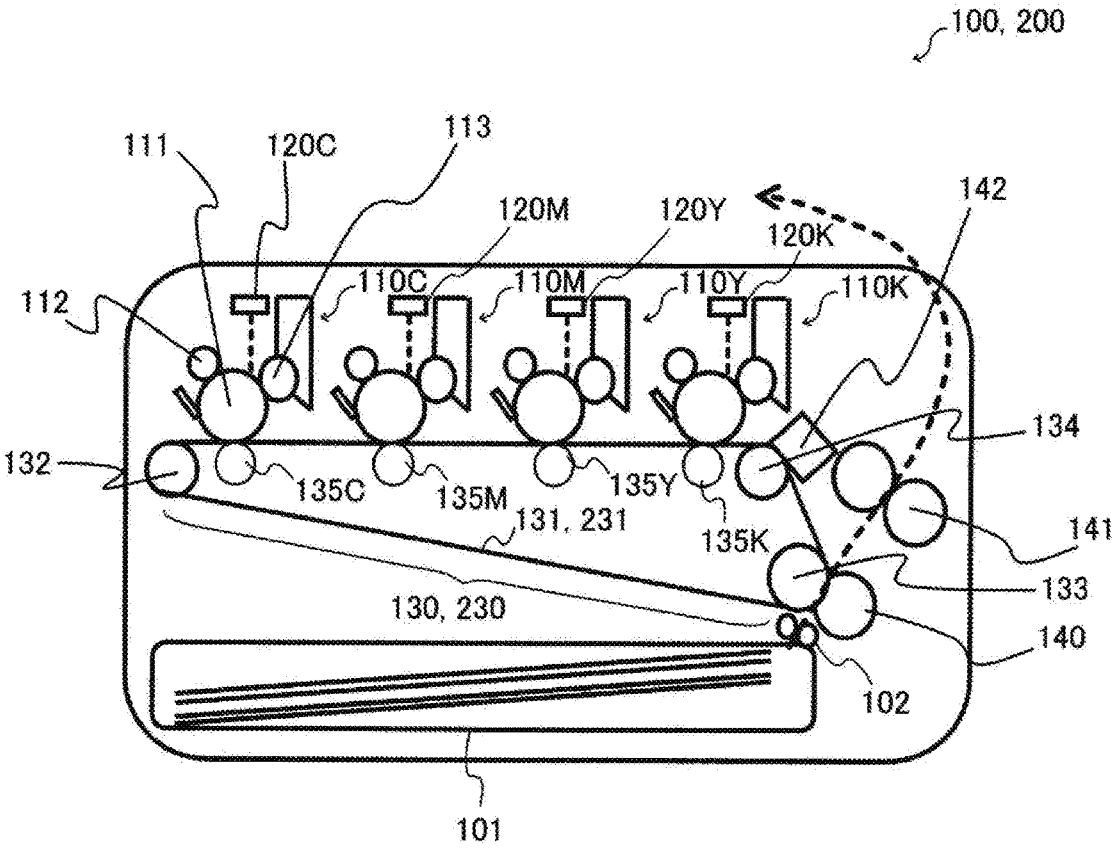
FIG. 1 is a diagram illustrating a schematic cross-sectional view of a configuration of an image formation apparatus according to Embodiments 1 and 2.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Embodiment 1

FIG. 1 is a diagram illustrating a schematic cross-sectional view of a configuration of an image formation apparatus 100 according to Embodiment 1 and an image formation apparatus according to Embodiment 2. The image formation apparatus 100 according to Embodiment 1 includes a sheet cassette 101, a feed roller 102 serving as a sheet feeder, image formation units 110C, 110M, 110Y, and 110K serving as image formation parts or devices, LED heads 120C, 120M, 120Y, and 120K serving as an exposure device, a transfer unit 130 serving as a primary transfer part or device, a secondary transfer roller 140 serving as a secondary transfer part or device, a fixation roller 141 serving as a fixation device, and a cleaning member 142.

In the sheet cassette 101, paper sheets serving as media are accommodated. The feed roller 102 takes out media one by one from the sheet cassette 101 and feeds out the taken medium to the secondary transfer roller 140.

Each of the image formation units 110C, 110M, 110Y, and 110K forms a toner image serving as a developer image of toner serving as developer of an assigned color. For example, the image formation unit 110C forms a toner image of cyan, the image formation unit 110M forms a toner image of magenta, the image formation unit 110Y forms a toner image of yellow, and the image formation unit 110K forms a toner image of black. Note that the image formation units 110C, 110M, 110Y, and 110K have the same configuration except for the colors of the toners used. Therefore, when the respective image formation units 110C, 110M, 110Y, and 110K do not have to be distinguished for explanation, the image formation units 110C, 110M, 110Y, and 110K may be simply referred to as the image formation unit 110.

Here, a configuration of the image formation unit 110C is explained below, as an example of the image formation units 110C, 110M, 110Y, and 110K. The image formation unit 110C includes a photosensitive drum 111, a charge roller 112 serving as a charging part or a charging device, and a development roller 113 serving as a development part or a development device.

The photosensitive drum 111 functions as an image carrier to carry an image. For example, the photosensitive drum 111 is formed with a photosensitive layer (a charge generation layer and a charge transport layer) layered on the surface of a cylindrical conductive support.

The charge roller 112 uniformly charges the surface of the photosensitive drum 111. The LED head 120C exposes light of an image onto the uniformly-charged surface of the photosensitive drum 111, so as to form an electrostatic latent image on the photosensitive drum 111. The development roller 113 applies the toner serving as the developer to the electrostatic latent image formed on the photosensitive drum 111, to thereby form a toner image serving as a developer image on the photosensitive drum 111.

The LED heads 120C, 120M, 120Y, and 120K are provided corresponding to the image formation units 110C, 110M, 110Y, and 110K, respectively. Thus, the LED heads 120C, 120M, 120Y, and 120K form electrostatic latent images onto the photosensitive drums 111 of the corresponding image formation units 110C, 110M, 110Y, and 110K. Note that the LED heads 120C, 120M, 120Y, and 120K also have the same configuration. Thus, when the respective LED heads 120C, 120M, 120Y, and 120K do not have to be distinguished for explanation, the LED heads 120C, 120M, 120Y, and 120K may be simply referred to as the LED head 120.

The transfer unit 130 is a belt unit on which the toner images formed by the image formation units 110 are transferred. The toner image(s) transferred to the transfer unit 130 are then secondary transferred by the secondary transfer roller 140 to the paper sheet being conveyed by the feed roller 102. The transfer unit 130 includes a belt 131 serving as an intermediate transfer belt, a drive roller 132 serving as a driving part or a driving device, driven rollers 133 and 134, and primary transfer rollers 135C, 135M, 135Y, and 135K.

The belt 131 is an endless belt (a seamless belt) and is wound around the drive roller 132 and the driven rollers 133 and 134. The belt 132 is conveyed (runs) by means of the drive of the drive roller 132. The belt 132 includes a first surface (e.g. an outer circumferential surface) thereof facing the image formation units 100 and a second surface (e.g. an inner circumferential surface) thereof opposed to the first surface. On the first surface of the belt 131 facing the image formation units 110, the toner images are transferred from the image formation units 110. The belt 131 is described in detail later.

The drive roller 132 is a roller to drive (run) the belt 131. Specifically, the drive roller 132 is in contact with the second surface of the belt 131 opposed to the first surface, and drives (runs) the belt 131. The driven rollers 133 and 134 are rollers that rotate according to the drive of the drive roller 132.

The primary transfer rollers 135C, 135M, 135Y, and 135K are provided corresponding to the image formation units 110C, 110M, 110Y, and 110K, respectively. The primary transfer rollers 135C, 135M, 135Y, and 135K receive a primary transfer voltage and function as a primary transfer part or a primary transfer device that primarily transfers the toner images on the photosensitive drums 111 of the corresponding image formation units 110C, 110M, 110Y, and 110K onto the belt 131. Note that the primary transfer rollers 135C, 135M, 135Y, and 135K have the same configuration, and thus when the primary transfer rollers 135C, 135M, 135Y, and 135K do not need to be distinguished, the primary transfer rollers 135C, 135M, 135Y, and 135K may be simply referred to as the primary transfer roller 135.

The secondary transfer roller 140 receives a secondary transfer voltage and thus secondarily transfers the toner images from the belt 131 to one sheet of the medium. The fixation roller 141 fixes the toner images transferred on the one sheet of the medium to the one sheet of the medium by heating and pressing the toner images, so as to form (print) an image on the one sheet of the medium. The medium having the image formed (printed) thereon is discharged to the outside of the image formation apparatus 100. The cleaning member 142 removes the toner remained on or foreign matter such as dusts attached to the belt 131.

The method for manufacturing the belt 131 is not particularly limited; however, in Embodiment 1, the belt 131 is manufactured as follows. As a material of the belt 131, polyimide (hereinafter, may be referred to as PI) is selected. A polyamide acid solution in which carbon black is dispersed in an appropriate amount in order to ensure conductivity is prepared according to the resistance value.

For example, the following methods or the like are available for obtaining a semiconductive polyamide acid. (i) A carbon black dispersion is obtained by dispersing carbon black in an organic polar solvent in the presence of a polymer dispersant. In the carbon black dispersion, a semiconductive polyamide acid solution obtained by polymerizing a polyamide acid is added with an imidization promoter, and mixed and stirred to obtain a uniform semiconductive polyamide acid solution. (ii) A carbon black dispersion is obtained by dispersing carbon black in an organic polar solvent such as N-methylpyrrolidone using a ball mill or the like in the presence of a polymer dispersant. An imide conversion catalyst is added to a semiconductive polyamide acid solution obtained by mixing the carbon black dispersion and a polyamide acid, and mixed and diffused to obtain a uniform semiconducting polyamide acid solution.

The obtained polyamide acid solution is applied to an inner surface of a rotating cylindrical mold to a predetermined film thickness. The applied polyamide acid solution is dried and baked to obtain a single-layer polyimide with a film thickness of 80 μm (micro meter) on the inner surface of the cylindrical mold.

It is preferable that the thickness of the belt 131 is not less than 60 μm and not more than 200 μm. In view of the flexibility of the belt 131 and the stress applied to the end of the belt 131 during driving, it is more preferable that the thickness of the belt 131 is not less than 60 μm and not more than 150 μm. Note that in Embodiment 1, the thickness of the belt 131 may be not less than 60 μm and not more than 100 μm, and is assumed to be 80 μm in this example.

To promote the imidization reaction of polyamide acid, high-temperature treatment at 200° C. (degrees Celsius) or higher is generally used. At 200° C. or lower, sufficient imide conversion cannot be obtained. On the other hand, the high-temperature treatment is advantageous for the imide conversion and provides stable characteristics, but the usage of thermal energy may cause poor thermal efficiency and high cost. Accordingly, the heat treatment temperature is determined in consideration of the productivity of the belt 131.

The material of the belt 131 is not limited to PI. From the viewpoint of durability or mechanical properties of the belt 131, it is preferable that the tension deformation during driving of the belt 131 is within a certain range. For example, similar to PI, the material of the belt 131 may be a material having a Young's modulus of not less than 2000 Mpa (Mega pascal), preferably not less than 3000 Mpa, which includes resin such as polyamide imide (PAI), polyether imide (PEI), polyphenylene sulfide (PPS), polyether ether ketone (PEEK), polyvinylidene fluoride (PVDF), polyamide (PA), polycarbonate (PC), polybutylene terephthalate (PBT), and the like or a resin-based material made of a mixture of two or more of these.

The solvent for manufacturing the belt 131 is appropriately determined depending on the material used, and aprotic polar solvent is preferably used as the solvent. Especially, N,N-dimethylacetamide, N,N-diethylformamide, N,N-dimethylsulfoxide, NMP mentioned above, pyridine, tetramethylene sulfone, dimethyltetramethylene sulfone, or the like may be used as the solvent. These may be used alone or may be used as a mixed solvent.

The carbon black used as a conductive agent includes furnace black, channel black, ketjen black, acetylene black, or the like which may be used alone or in combination. Types of these carbon blacks can be appropriately selected depending on the desired conductivity. For the belt 131 according to Embodiment 1, especially, channel black or furnace black is preferably used to obtain a given resistance. However, depending on the application of the belt 131, carbon black treated to prevent oxidative deterioration such as oxidized carbon black, grafted carbon black, or the like, or carbon black with improved dispersibility in a solvent may be preferably used.

An amount of the carbon black in the belt 131 of Embodiment 1 is 3% to 40% by weight, more preferably 3% to 30% by weight, with respect to the resin solid content, in view of the mechanical strength or the like. Further, the method for adding conductivity is not limited to the electronic conduction method using the carbon black or the like, and a predetermined conductivity may be imparted by adding an ion conductive agent.

In Embodiment 1, the belts 131#1 to 131#6 of Examples 1 to 6 are made by the inventor according to the manufacturing method described above by using PI as the main material with carbon black added whose amount is changed for each of Examples 1 to 6 so that the belts 131#1 to 131#6 of Examples 1 to 6 have the layer thickness of 80 μm and the surface resistivity (ρs) different in each of Examples 1 to 6. The following experiments are conducted on the belts 131#1 to 131#6 of Examples 1 to 6.

The surface resistivity (ρs) of each of the belts 131#1 to 131#6 manufactured as described above is measured under the following conditions (a) to (e) using a Hiresta-UP/UR-100 probe of Mitsubishi Chemical Analytic Co. Ltd. The surface resistivity (ρs) of each of the inner circumferential surface and the outer circumferential surface of each of the belts 131#1 to 131#6 and the surface resistivity difference between the inner and outer circumferential surfaces (Δρs=ρs of the outer circumferential surface−ρs of the inner circumferential surface) are calculated.

Here, measurement conditions for the surface resistivity are the followings (a) to (e).

(a) The measurement environment is normal temperature (25° C.) and normal humidity (50%), provided that the measurement targets are left in the measurement environment for 24 hours or more before the measurement.

(b) The applied voltage is 500 V (Volt).

(c) The application time is 10 s (second).

(d) The applied load is 500 g (gram).

(e) The measurement surfaces are the outer and inner circumferential surfaces of each of the belts 131#1 to 131#6.

Figure 2:
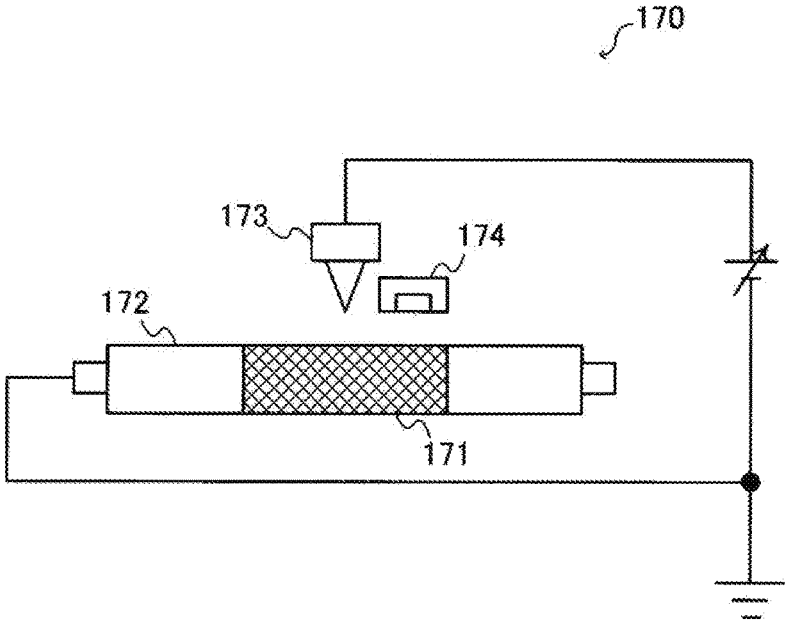
FIG. 2 is a diagram illustrating a schematic view for explaining a measuring device.

Further, the charging characteristics of the outer circumferential surfaces of the belts 131#1 to 131#6 are measured using a measuring device 170 such as being illustrated in FIG. 2. Specifically, each of the belts 131#1 to 131#6 is cut into an appropriate size and wound around a metal shaft 172 having a diameter of 30 mm (millimeter) so as to obtain a wound measurement target 171. A voltage of 6 KV (Kilovolts) is applied from an electrode 173 to the outer circumferential surface of the measurement target 171 so that the outer circumferential surface of the measurement target 171 is charged.

Then, the surface potential of the measurement target 171 is measured with the electrometer probe 174 at 0.1 second intervals from 0.1 seconds to 2 seconds after the voltage is applied to the measurement target 171. Here, the surface potential after 0.1 seconds is referred to as $V_0$ and the surface potential after 0.5 seconds is referred to as $V_1$. The measurement results on the surface resistivity (ρs), the surface resistivity difference (Δρs) between the inner and outer circumferential surfaces, and the surface potentials $V_0$ and $V_1$ are illustrated in FIG. 3.

In Embodiment 1, toner with the following characteristics is used. The composition of the toner includes styrene-acrylic copolymer as the main component with paraffin wax included. Each toner particle includes a resin toner body and an external additive such as silica added to a surface of the resin toner body to adjust the charge, and an average particle size thereof is 7.0 μm and a circularity is 0.95.

The toner described above is selected to be used because of its ability to obtain image sharpness and high image quality, due to high transfer efficiency, no releasing agent for fixing, and excellent dot reproducibility and resolution thereof.

Figure 4:
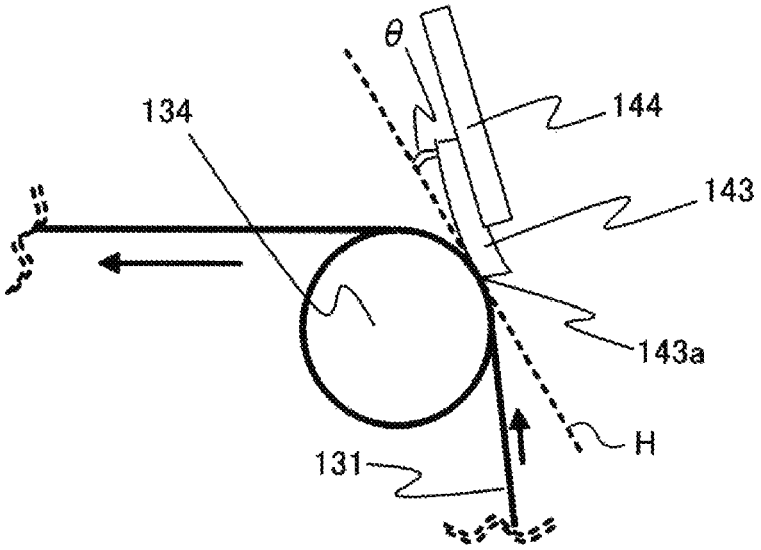
FIG. 4 is a diagram illustrating a schematic view for explaining a cleaning member.

For the cleaning member 142 for cleaning the belt (131#1 to 131#6), blade cleaning such as being illustrated in FIG. 4 is used. For a blade 143 of the cleaning member 142, an elastic material with rubber hardness in the range of JIS (Japanese Industrial Standards) A 65° to 100° is suitable. In Embodiment 1, JIS A 78° urethane rubber with a plate thickness of 2.0 mm is used for the blade 143 and the blade 143 is fixed by a support member 144.

This is because the blade method made of an elastic material such as urethane rubber has an excellent function of removing residual toner or foreign matter, and its configuration is simple, compact and low cost. Also, urethane rubber is suitable as the rubber material because it has high hardness and elasticity, and is excellent in abrasion resistance, mechanical strength, oil resistance and ozone resistance.

The linear pressure of the blade 143 is set to 1 to 6 g/mm, preferably 2 to 5 g/mm. In Embodiment 1, the linear pressure of the blade 143 is set to 4.3 g/mm. This is because if the linear pressure is too low, the contact with the belt 131 becomes insufficient and cleaning failure may easily occur. On the other hand, if the linear pressure is too large, the contact with the belt (131#1 to 131#6) becomes a surface contact, the frictional resistance becomes excessive, and the pressing force exceeds the scraping force, so that the blade 143 may be curled.

Further, the contact angle θ between the blade 143 and the belt (131#1 to 131#6) is preferably 20° to 30°, more preferably 20° to 25°. In Embodiment 1, the blade 143 is disposed in such a manner that the contact angle θ is 21°. Note that the contact angel θ is an angle between a tip 143*a* of the blade 143 and the tangent line H of the belt surface at the contact point between the tip 143*a* of the blade 143 and the belt surface.

Note that the method of the blade cleaning is not limited to the case where the blade 143 is in contact with the curved surface where the belt is supported by the driven roller 134 as illustrated in FIG. 4. The blade may be in contact with a flat surface of the belt.

The inventor performs evaluations on the transfer efficiency and the transferred image in the secondary transfer process using the image formation apparatus 100 illustrated in FIG. 1. First, the evaluation method on the secondary transfer efficiency is explained.

Evaluation conditions are the followings (f) to (h).

(f) The printing environment is hot and humid with a temperature of 28° C. and a humidity of 80%.

(g) The print medium is a paper sheet of A4 size Excellent White manufactured by Oki Data Co., Ltd.

(h) The evaluation image is a 100% solid single image of cyan.

Here, the print image density in a predetermined printable area such as an area corresponding to one page of a print medium, an area corresponding to one cycle of the photosensitive drum, or the like is calculated by the following formula (1), for example. Note that a 100% solid image has the print image density of 100%.

$$\text{Print image density}=\{Cm(i)/(Cd\times C0)\}\times 100 \quad (1)$$

Cm(i) is the number of dots actually used in printing (that is, the number of dots actually exposed in printing) while the photosensitive drum 111 rotates Cd times.

C0 is the maximum number of dots that can be printed per one rotation of the photosensitive drum 111, regardless of whether or not exposure is performed. Note that C0 is the number of dots used for a solid image per one rotation of the photosensitive drum 111. That is, Cd×C0 is the maximum number of dots that can be printed while the photosensitive drum 111 rotates Cd times.

The evaluation procedure is the followings (i) to (n).

(i) The primary transfer voltage is determined. The primary transfer voltage is determined to the voltage of +200 V at which transfer blurring begins to occur in Vertical 30 mm×Horizontal 20 mm blue patch (100% cyan & 100% magenta).

(j) The secondary transfer voltage is determined. The secondary transfer voltage is determined to the voltage of +200 V at which transfer blurring begins to occur in Vertical 30 mm×Horizontal 20 mm blue patch (100% cyan & 100% magenta).

(k) The evaluation density is adjusted. The development bias is adjusted such that the density of the 100% solid image of cyan printed on a paper sheet of Excellent White has an OD (Optical Density) value of 1.5.

(l) The weight of the toner per unit area on the belt 131 before the secondary transfer is measured. Specifically, in a middle of the secondary transfer of the toner from the belt to the medium, the secondary transfer is stopped. The amount of the toner per unit area on the belt (131#1 to 131#6) before secondary transfer (that is, the amount of the toner per unit area on a part of the belt that has not yet contact with the medium for the second transfer) is measured with a jig. Note that the amount of the toner per unit area attached on the belt before the secondary transfer is usually about 0.6 to 0.7 cg/cm$^2$.

(m) For each of the toner types, the relational formula between the weight of the toner adhered to the medium per unit area and the density of the image printed on the medium is calculated in the following procedures (m-1) to (m-5).

(m-1) In a middle of the secondary transfer of the toner from the belt to the medium, the secondary transfer is stopped. The amount of the toner per unit area transferred to the medium is measured with a jig. The specific procedure is as follows. First, the medium on which the toner has been transferred is wounded around a development roller formed of a metal shaft covered with rubber, and an FG (Frame Grand) is connected to the metal shaft of the development roller. Next, a double-sided tape is attached to the surface of the jig made of metal, and an electrode is connected to the jig. Then, while a positive voltage is applied to the jig, the toner attached on the medium is attracted by the adhesive force of the double-sided tape and the electric field caused by the metal jig so as to be collected from the medium to the double-sided tape. Then, the weight of the collected toner is measured. The toner adhesion amount on the medium per unit area (the amount of the toner per unit area transferred to the medium) is expressed by the weight per 1 cm$^2$ (mg/cm$^2$).

More specifically, the double-sided tape is attached to the flat surface area of the metal jig (in an area of 1 cm$^2$), and a +300 V DC voltage is applied to the metal jig from an external power supply. In a middle of the secondary transfer of the toner from the belt to the medium, the secondary transfer is stopped. Then, the metal jig having+300 V DC voltage applied is pressed once onto a predetermined position of a print pattern (a toner image) transferred to the medium that has not yet reached to the fixation roller 141 and thus collects the toner from the medium to the metal jig. Then, the weight of the toner attached to the metal jig is measured with an electronic balance (Sartorius, CAP225D). Based on the difference in weight of the metal jig between before and after the collection of the toner, the toner adhesion amount on the medium per unit area (mg/cm$^2$) is calculated.

(m-2) Without stopping the secondary transfer in a middle of the secondary transfer unlike the procedure (m-1), the image is printed on the medium. The density (OD) of the image printed on the medium is measured with X-Rite528 measuring instrument. Here, for the measuring of the image density, the measuring conditions in the measuring instrument "X-Rite528" are set as follows. The measurement mode is set to "Density measurement mode", the status is set to "Status I", the white reference is set to "Absolute white reference", and the polarizing filter is set to "No polarizing filter". After calibrating with a white calibration plate, the image density is measured. Note that "Status I" is setting of the wavelength range to be evaluated, and specified in "ISO5-3: Photography and graphic technology-Density Measurements—Part 3: Spectral conditions."

At the time of the measurement of the image density on the printed matter, a black medium (that is, black paper) is used as an underlayment for the printed matter. Specifically, as the underlayment for the printed matter, the black paper is used that satisfies $25.1 \le L^*(B) \le 25.9$, $0.2 \le a^*(B) \le 0.3$, and $0.5 \le b^*(B) \le 0.7$, where the L* value, a* value and b* value in the L*a*b* color system are L*(B), a*(B) and b*(B)

respectively. For example, "color fine paper, black" (Hokuetsu Kishu Paper) is used as the black paper.

With the above described setting, the measuring instrument "X-Rite528" can obtain the image density as four values: V value (Visual Value), Y value (Yellow Value), M value (Magenta Value), and C value (Cyan Value). Note that the optical density (OD) measured in the above described conditions is defined as "the image density".

(m-3) With a different development bias to change the amount of the toner primarily transferred to the belt, the procedures (m-1) and (m-2) are repeated.

(m-4) Procedure (m-3) is repeated 10 times. That is, the procedures (m-1) and (m-2) are executed with ten different development biases.

(m-5) The relational formula of the required toner weight to the image density is calculated.

(n) The current dependence of the transfer efficiency is evaluated.

With each of predetermined secondary transfer voltages, an evaluation pattern is printed on a paper sheet of Excellent White as the medium. In a middle of the secondary transfer of the toner image from the belt to the medium, the secondary transfer is stopped. In this state, the weight of the toner per unit area on the belt (131#1 to 131#6) before the secondary transfer, and the weight of the toner remaining on the belt per unit area after the secondary transfer are measured, and then the transfer efficiency is calculated by the following formula (2).

$$\text{Transfer efficiency (\%)}=\{1-(\text{the weight of toner per unit area remaining on the belt after the secondary transfer})/(\text{the weight of toner per unit area on the belt before the secondary transfer})\}\times 100 \quad (2)$$

Figure 5:
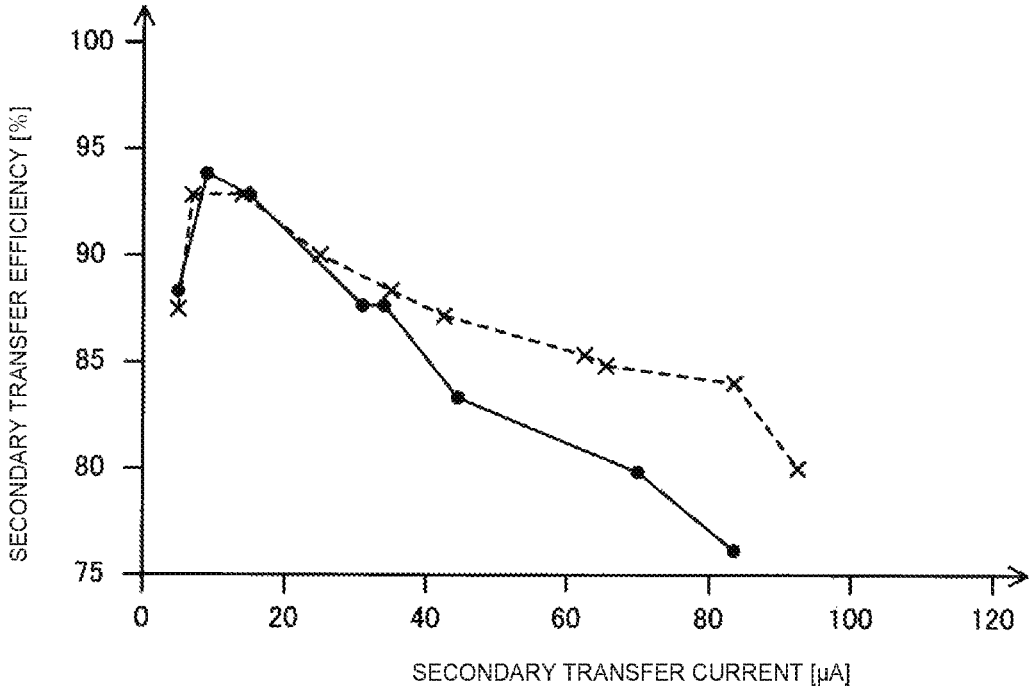
FIG. 5 is a diagram illustrating a graph indicating a relationship between a secondary transfer current and a secondary transfer efficiency in Examples 4 and 6.

In Embodiment 1, the inventor calculates the weight of toner by the formula (2) obtained by the procedure (n), and calculates the transfer efficiency as follows. First, the inventor peels off the remaining toner (the toner remaining on the belt after the secondary transfer) with scotch tape, and attaches the peeled toner to a A3 size paper sheet of Excellent White serving as standard paper. Next, the inventor measures the density (OD value) of the attached toner, and calculates the weight of toner per unit area remaining on the belt after the secondary transfer according to a predetermined conversion formula regarding the relationship between the toner weight and the toner density. Note that when the evaluations are executed while changing the secondary transfer voltage, the inventor reads out the execution current of the secondary transfer voltage from an oscilloscope. The results illustrated in FIGS. 3 and 5 are obtained.

(g) Next, transfer streaks are evaluated. In Embodiment 1, the inventor executes the image evaluation of the transfer streaks on the image (the 100% solid image of cyan) on the print medium that has been evaluated on the secondary transfer efficiency. That is, the presence or absence of the transfer streaks and the level of occurrence of the transfer streaks are evaluated in a range between the transfer current of 60 μA (microampere) and the transfer current in which the secondary transfer efficiency is at the highest illustrated in FIG. 5. The evaluation results are illustrated in FIG. 3.

The judgment criteria for the transfer streaks are as follows.

Lv4 (Level 4): no transfer streaks (●)

Lv3 (Level 3): less than 5 transfer streaks (♦)

Lv2 (Level 2): not less than 5 and less than 20 transfer streaks (▲)

Lv1 (Level 1): not less than 20 transfer streaks (x)

The inventor evaluates the secondary transfer efficiency and the level of the transfer streaks on each of the belts 131#1 to 131#6 of Examples 1 to 6, in the above described procedure. Note that the current dependence of the secondary transfer efficiency is calculated as the slope of the transfer efficiency in the range of the execution current of the secondary transfer current of 20 to 80 μA. The target of the absolute value of the slope is set to 0.1 or less.

The reasons for setting the target value of the current dependence are the followings (o) to (q).

(o) In order to make the secondary transfer efficiency under the secondary transfer current of 40 to 60 μA, which is the secondary transfer current in the actual use, 90% or more, which is a sufficiently high efficiency.

(p) In order to suppress density variations (unevenness) due to transfer within one page, by making the secondary transfer efficiency 90% or more, even in high-temperature and high-humidity environments that are disadvantageous to the secondary transfer efficiency in which the toner charge is difficult to be risen.

(q) In order to maintain the secondary transfer efficiency high and suppress the density difference between pages by suppressing the current dependence, even if the transfer current varies due to variations of the printing environment such as temperature or humidity, the thickness of the medium, the resistance of the medium, and/or the like.

FIG. 5 is a graph indicating the relationship between the secondary transfer current and the secondary transfer efficiency in Examples 4 and 6 out of Examples 1 to 6 illustrated in FIG. 3 In FIG. 5, the relationship between the secondary transfer current and the secondary transfer efficiency of Example 4 is illustrated by the dashed line, and the relationship between the secondary transfer current and the secondary transfer efficiency of Example 6 is illustrated by the solid line. It is found based on the evaluation results indicated in FIGS. 3 and 5 that there is a positive correlation between the surface resistivity ρs1 and the current dependence a of the secondary transfer efficiency in the single-layered belt 131 and that the larger the surface resistivity ρs1 is, the larger the current dependence a is.

Figure 6:
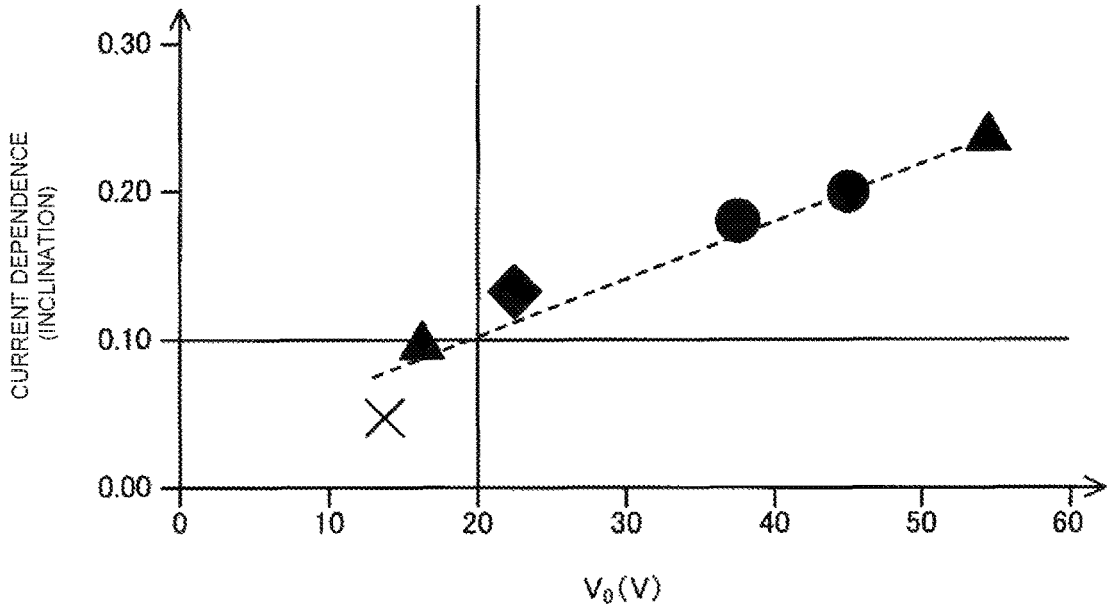
FIG. 6 is a diagram illustrating a graph indicating a relationship between a surface potential and a current dependence in Examples 1 to 6.

FIG. 6 is a graph indicating the relationship between the surface potential $V_0$ and the current dependence in Examples 1 to 6 illustrated in FIG. 3. As indicated in FIGS. 3 and 6, it is found that when the surface potential $V_0$ of the belts 131#1 to 131#6 is 20 V or less, the current dependence a of the secondary transfer efficiency is 0.1 or less.

The reason why the surface resistivity ρs1 decreases as the current dependence a of the secondary transfer efficiency decreases is presumed as follows. It is considered that, in a case where the surface resistivity ρs1 of the belt 131 is large, the surface potential $V_0$ of the belt 131 immediately after high voltage application is large so that the change of the surface potential $V_0$ with time after the high voltage application becomes large, and thus the toner potential on the belt 131 immediately after the primary transfer is attenuated via the belt 131 so that the toner charge becomes low.

Accordingly, this presumably causes unevenness of the toner potential on the belt 131, and thus causes a part of the toner that is insufficiently charged to be less likely to be transferred from the belt 131 to the medium by the electric field upon the secondary transfer. On the other hand, it is presumed that, in a case where the surface resistivity ρs1 of the belt 131 is small, the surface of the belt 131 is difficult to be charged so that the surface potential $V_0$ of the belt 131 becomes 20 V or less, and thus the change of the surface potential $V_0$ with time is low and stable, as shown in the comparison between $V_0$ and $V_1$ in FIG. 3. That is, it is presumed that, even if the primary transfer voltage is applied and the toner is transferred onto the belt 131, the surface of the belt 131 is difficult to be charged. Therefore, it is considered that the toner potential on the belt 131 immediately after the primary transfer is less likely to be attenuated via the belt 131, which suppresses the decrease in the toner charge, and thus reduces the uneven charge of the toner layer on the belt 131. As a result, the toner on the belt 131 can be stably and uniformly transferred to the medium.

Therefore, when the belt 131 is used whose surface potential $V_0$ immediately after the application of 6000 V to the outer circumferential surface of the belt 131 (after 0.1 seconds) becomes 20 V or less, the current dependence of the secondary transfer efficiency a can be suppressed to 0.1 or less, and thus the secondary transfer efficiency of 90% or more can be achieved. As a result, it is possible to reduce affects of variations of the printing environment, the thickness of the medium, and/or the uneven resistance to the secondary transfer efficiency, and to suppress the density unevenness in a page or the density difference between pages.

Embodiment 2

As illustrated in FIG. 1, an image formation apparatus 200 according to Embodiment 2 includes the sheet cassette 101, the feed roller 102, the image formation units 110, the LED head 120, a transfer unit 230, the secondary transfer roller 140, the fixation roller 141, and the cleaning member 142.

The sheet cassette 101, the feed roller 102, the image formation units 110, the LED heads 120, the secondary transfer roller 140, the fixation roller 141, and the cleaning member 142 in the image formation apparatus 200 according to Embodiment 2 have the same configurations as the sheet cassette 101, the feed roller 102, the image formation units 110, the LED heads 120, the secondary transfer roller 140, the fixation roller 141, and the cleaning member 142 in the image formation apparatus 100 according to Embodiment 1.

The transfer unit 230 is a belt unit onto which the toner images formed by the image formation units 110 are primarily transferred. The transfer unit 230 includes a belt 231, the drive roller 132, the driven rollers 133 and 134, and the primary transfer rollers 135. The drive roller 132, the driven rollers 133 and 134 and the primary transfer rollers 135 of the transfer unit 230 in Embodiment 2 have the same configurations as the drive roller 132, the driven rollers 133 and 134 and the primary transfer of the transfer unit 130 in Embodiment 1, respectively.

The belt 231 is an endless belt (or a seamless belt) and is wound around the drive roller 132 and the driven rollers 133 and 134. The belt 231 is conveyed (runs) by means of the drive of the drive roller 132.

The method for manufacturing the belt 231 is not particularly limited; however, in Embodiment 2, the belt 231 is manufactured as follows. As a material of the belt 231, PI is selected. Two polyamide acid solutions having different resistance values are prepared and each of which carbon black is dispersed in an appropriate amount in order to ensure conductivity. Hereinafter, one of the prepared two polyamide acid solutions is referred to as a first polyamide acid solution and the other of the prepared two is referred to as a second polyamide acid solution.

The first polyamide acid solution is applied to an inner surface of a rotating cylindrical mold to a predetermined film thickness. The applied first polyamide acid solution is dried and baked, to obtain a first polyimide layer with a film thickness of 40 μm on the inner surface of the cylindrical mold.

Next, similar to the first polyimide layer, the second polyamide acid solution is applied onto the first polyimide layer on the inner surface of the rotating cylindrical mold to a predetermined film thickness. The applied second polyamide acid solution is dried and baked to form a second polyimide layer, so as to obtain the belt 231 having the first polyimide layer and the second polyimide layer wherein the total film thickness of the belt is 80 μm. That is, the second polyimide layer forms an inner circumferential surface of the belt 231 and the first polyimide layer forms an outer circumferential surface of the belt 231.

Note that, like Embodiment 1, it is preferable that the thickness of the belt 231 having the first layer and the second layer is not less than 60 μm and not more than 200 μm. In view of the flexibility of the belt 231 and the stress applied to the end of the belt 231 during driving, it is more preferable that the thickness of the belt 231 is not less than 60 μm and not more than 150 μm. Even more preferably, the thickness of the belt 231 is not less than 60 μm and not more than 130 μm. In the following example(s), the thickness of the belt 231 is 80 μm or 120 μm. Here, it is preferable that the first layer is not less than 30 μm and not more than 80 μm, and the second layer is not less than 30 μm and not more than 50 μm.

To promote the imidization reaction of polyamide acid, high-temperature treatment at 200° C. or higher is generally used. At 200° C. or lower, sufficient imide conversion cannot be obtained. On the other hand, the high-temperature treatment is advantageous for the imide conversion and provides stable characteristics, but the usage of thermal energy causes poor thermal efficiency and high cost. Accordingly, the heat treatment temperature is determined in consideration of the productivity of the belt 231.

In Embodiment 2, the belt 231 having the predetermined thickness is formed by sequentially applying liquid material for the layers. The material of the belt 231 are not limited to PI. From the viewpoint of durability or mechanical properties of the belt 231, it is preferable that the tension deformation during driving of the belt 231 is within a certain range. For example, similar to PI, the material of the belt 231 may be a material having a Young's modulus of 2000 Mpa (Mega pascal) or more, preferably 3000 Mpa, which include resin such as PAI, PEI, PPS, PEEK, PVDF, PA, PC, PBT, and the like or a resin-based material made of a mixture of two or more of these. In Embodiment 2, PI is used as the main component of the belt material. As long as the main component is the same, it can be said that the belt material is substantially the same. Note that in Embodiment 2, the first layer and the second layer may be formed of a first resin and a second resin different from the first resin, respectively.

The solvent for manufacturing the belt 231 is appropriately determined depending on the material used, and aprotic polar solvent is preferably used as the solvent. Especially, N,N-dimethylacetamide, N,N-diethylformamide, N,N-dimethylsulfoxide, NMP mentioned above, pyridine, tetramethylene sulfone, dimethyltetramethylene sulfone, or the like may be used as the solvent. These may be used alone or may be used as a mixed solvent.

The carbon black used as a conductive agent includes furnace black, channel black, ketjen black, acetylene black, or the like which may be used alone or in combination. Types of these carbon blacks can be appropriately selected depending on the desired conductivity. For the belt 231 according to Embodiment 2, especially, channel black or furnace black is preferably used to obtain a given resistance. However, depending on the application of the belt 231, carbon black treated to prevent oxidative deterioration such as oxidized carbon black, grafted carbon black, or the like, or carbon black with improved dispersibility in a solvent may be preferably used.

An amount of the carbon black in the belt 231 of Embodiment 2 is 3% to 40% by weight, more preferably 3% to 30% by weight, with respect to the resin solid content, in view of the mechanical strength or the like. Further, the method for adding conductivity is not limited to the electronic conduction method using the carbon black or the like, and a predetermined conductivity may be imparted by adding an ion conductive agent.

In Embodiment 2, the belts 231#7 to 231#14 of Examples 7 to 14 are made by the inventor according to the manufacturing method described above by using PI as the main material with the carbon black added whose amount is changed for each of Examples 7 to 14 so that the belts 231#7 to 231#14 of Examples 7 to 14 have the layer thickness of 80 μm or 120 μm and the surface resistivity (ρs) different in each of Examples 1 to 6. The experiments same as or similar to Embodiment 1 are conducted on the belts 231#7 to 231#14 of Examples 7 to 14 according to Embodiment 2.

Specifically, the belt 231#7 of Example 7 is manufactured by forming the first layer whose thickness is 40 μm by using the polyamide acid solution used for manufacturing Example 3 in Embodiment 1 and then forming the second layer whose thickness is 40 μm by using the polyamide acid solution that is used for manufacturing Comparison Example 2 in Embodiment 1. Similarly, the belt 231#8 of Example 8 is manufactured by forming the first layer whose thickness is 40 μm by using the polyamide acid solution of Example 4 and then forming the second layer whose thickness is 40 μm by using the polyamide acid solution of Example 5. The belt 231#9 of Example 9 is manufactured by forming the first layer whose thickness is 40 μm by using the polyamide acid solution of Example 5 and then forming the second layer whose thickness is 40 μm by using the polyamide acid solution of Example 4. The belt 231#10 of Example 10 is manufactured by forming the first layer whose thickness is 40 μm by using the polyamide acid solution of Example 6 and then forming the second layer whose thickness is 40 μm by using the polyamide acid solution of Example 2.

The belt 231#11 of Example 11 is manufactured by forming the first layer whose thickness is 80 μm by using a polyamide acid solution having PI as the main material with the carbon black added whose amount is adjusted such that the surface resistivity (ρs) is 12.0 log Ω/□ and then forming the second layer whose thickness is 40 μm by using the polyamide acid solution of Example 4. The belt 231#12 of Example 12 is manufactured by forming the first layer whose thickness is 80 μm by using a polyamide acid solution having PI as the main material with the carbon black added whose amount is adjusted such that the surface resistivity (ρs) is 13.0 log Ω/□ and then forming the second layer whose thickness is 40 μm by using the polyamide acid solution of Example 2. The belt 231#13 of Example 13 is manufactured by forming the first layer whose thickness is 80 μm by using a polyamide acid solution having PI as the main material with the carbon black added whose amount is adjusted such that the surface resistivity (ρs) is 13.0 log Ω/□ and then forming the second layer whose thickness is 40 μm by using the polyamide acid solution of Example 4. The belt 231#14 of Example 14 is manufactured by forming the first layer whose thickness is 80 μm by using a polyamide acid solution having PI as the main material with the carbon black added whose amount is adjusted such that the surface resistivity (ρs) is 13.0 log Ω/□ and then forming the second layer whose thickness is 40 μm by using the polyamide acid solution of Example 5.

The inventor conducts experiments same as or similar to those of Embodiment 1 on the belts 231#7 to 231#14 of Examples 7 to 14. FIG. 7 illustrates the evaluation results of Examples 7 to 14 according to Embodiment 2. Note that FIG. 7 also illustrates the evaluation results of Examples 1 to 6 according to Embodiment 1.

Figure 8:
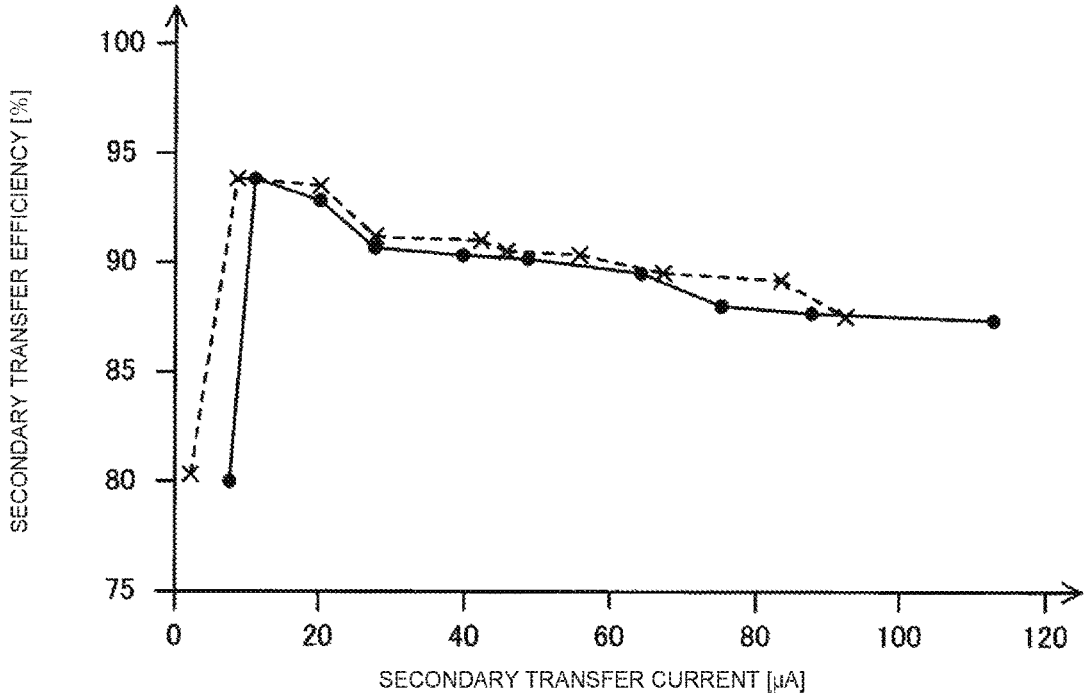
FIG. 8 is a diagram illustrating a graph indicating a relationship between a secondary transfer current and a secondary transfer efficiency in Examples 9 and 14 out of Examples 7 to 14.

FIG. 8 is a graph illustrating the relationship between the secondary transfer current and the secondary transfer efficiency in Examples 9 and 14 out of Example 7 to 14 illustrated in FIG. 7. In FIG. 8, the relationship between the secondary transfer current and the secondary transfer efficiency on Example 14 is indicated by the dashed line, and the relationship between the secondary transfer current and the secondary transfer efficiency on Example 9 is indicated by the solid line.

The evaluation results illustrated in FIGS. 3 and 5 indicate that the single-layered belt 131 according to Embodiment 1 has a positive correlation between the surface resistivity ρs1 and the current dependence a of the transfer efficiency, and thus the current dependence a increases as the surface resistivity ρs1 increases. To the contrary, the evaluation results illustrated in FIGS. 7 and 8 indicate that, in the two-layered belt 231 according to Embodiment 2, the dependence of α on ρs1 is small, α is less than 0.1 for ρs1 in the range from 9.4 to 11.6, and the high secondary transfer efficiency can be maintained regardless of the value of the secondary transfer current.

Figure 9:
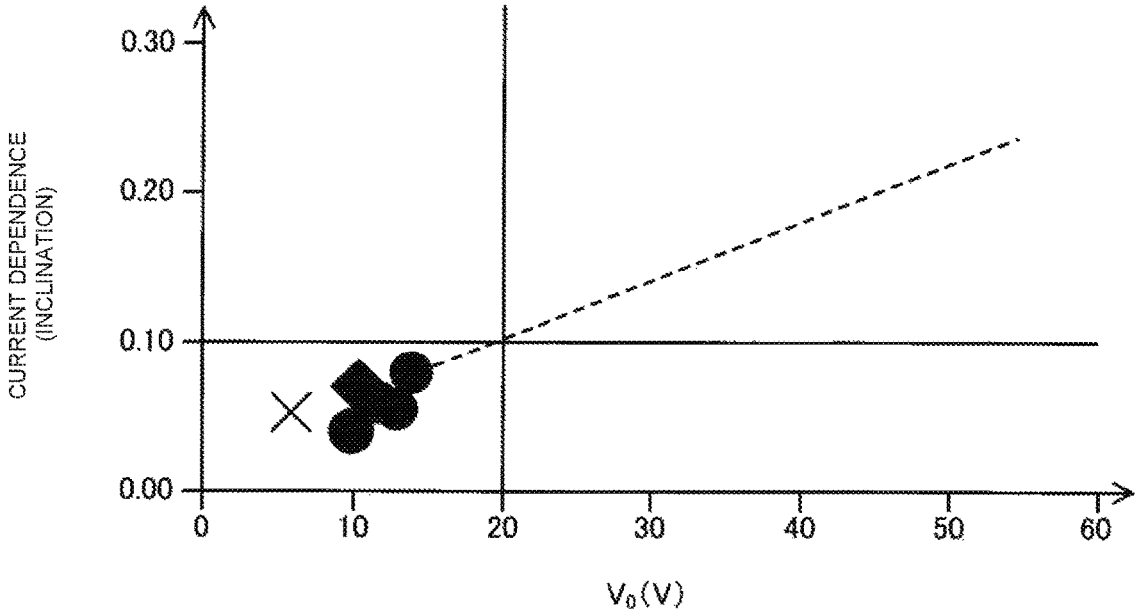
FIG. 9 is a diagram illustrating a graph indicating a relationship between surface potential and current dependence in Examples 7 to 14.

FIG. 9 is a graph illustrating the relationship between the surface potential $V_0$ and the current dependence in Examples 7 to 14 illustrated in FIG. 7. As illustrated in FIGS. 7 and 9, in the cases where the surface potential $V_0$ of the belt (231#7 to 231#14) is not more than 20 V, the current dependence a of the secondary transfer efficiency is not more than 0.1. The reason for this is the same as in Embodiment 1.

Figure 10:
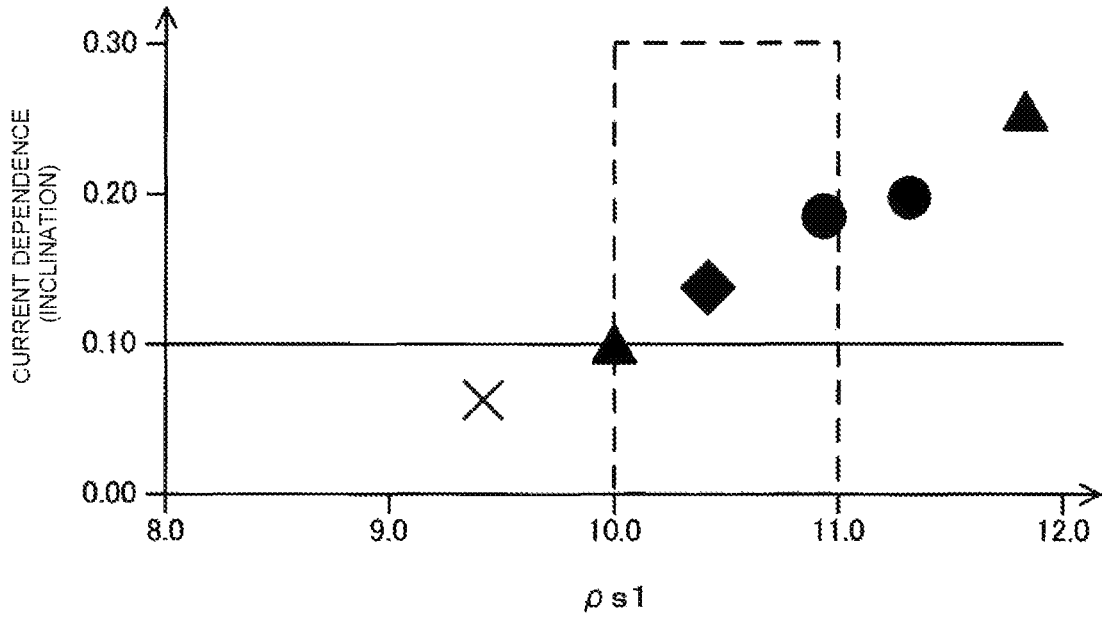
FIG. 10 is a diagram illustrating a graph indicating a relationship between surface resistivity and current dependence in Examples 1 to 6 according to Embodiment 1.
Figure 11:
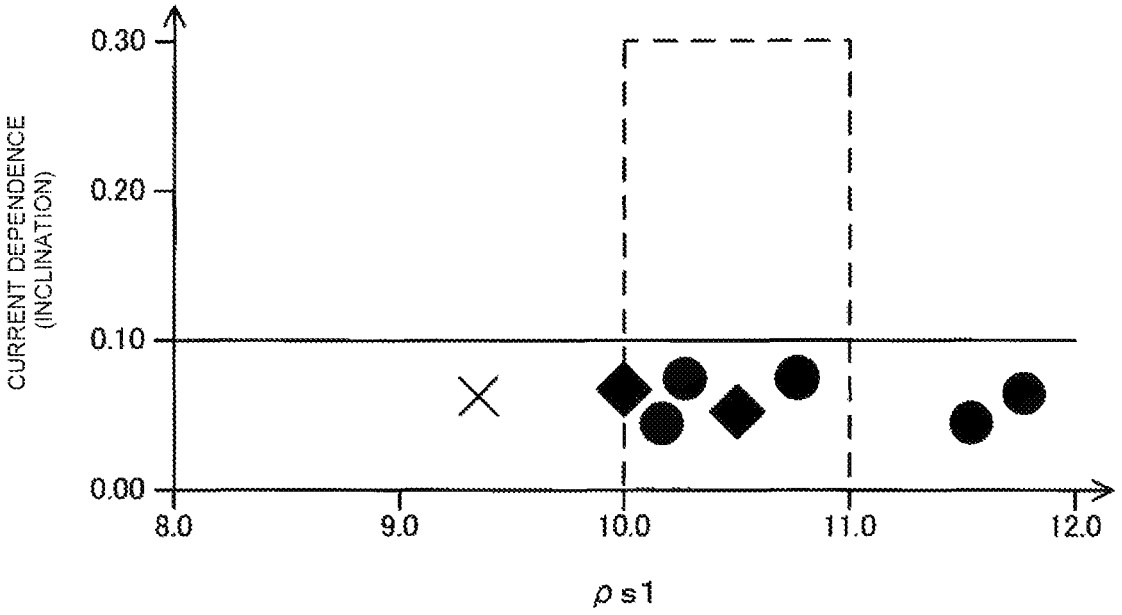
FIG. 11 is a diagram illustrating a graph indicating a relationship between surface resistivity and current dependence in Examples 7 to 14 according to Embodiment 2.

FIG. 10 is a graph illustrating the relationship between the surface resistivity ρs1 and the current dependence in Examples 1 to 6 according to Embodiment 1. FIG. 11 is a graph illustrating the relationship between the surface resistivity ρs1 and the current dependence in Examples 7 to 14 according to Embodiment 2.

FIG. 10 indicates that the current dependence tends to increase as the surface resistivity ρs1 increases in Embodiment 1. On the other hand, FIG. 11 indicates the current dependence does not increase even if the surface resistivity ρs1 increases in Embodiment 2.

It is generally considered that discharge streaks occur when ρs1 is less than 10.0 (ρs1<10.0), and color horizontal streaks occur when ρs1 is more than 11.0 (11.0<ρs1). Therefore, in general, the belt having ρs1 in the range from 10.0 to 11.0 (10.0≤ρs1≤11.0) may be needed.

Figure 12:
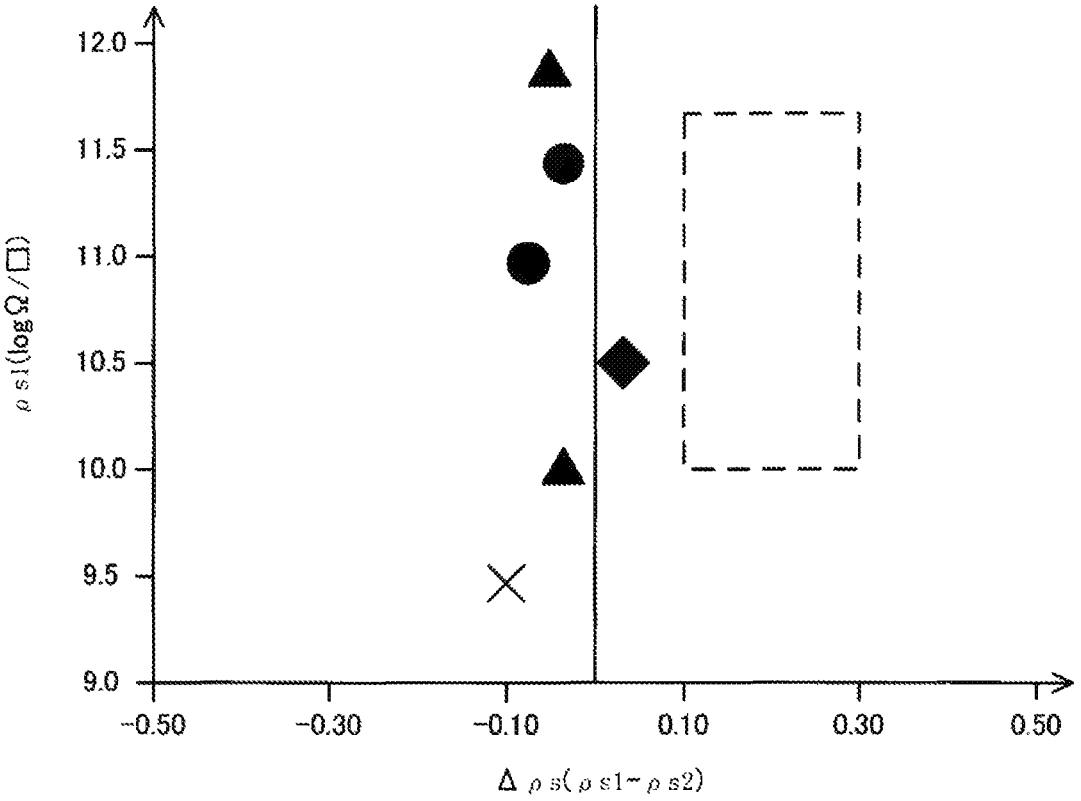
FIG. 12 is a diagram illustrating a graph indicating a relationship between the surface resistivity of the belt and difference in the surface resistivity between the inner and outer circumferential surfaces of the belt in Example 1 to 6 according to Embodiment 1.
Figure 13:
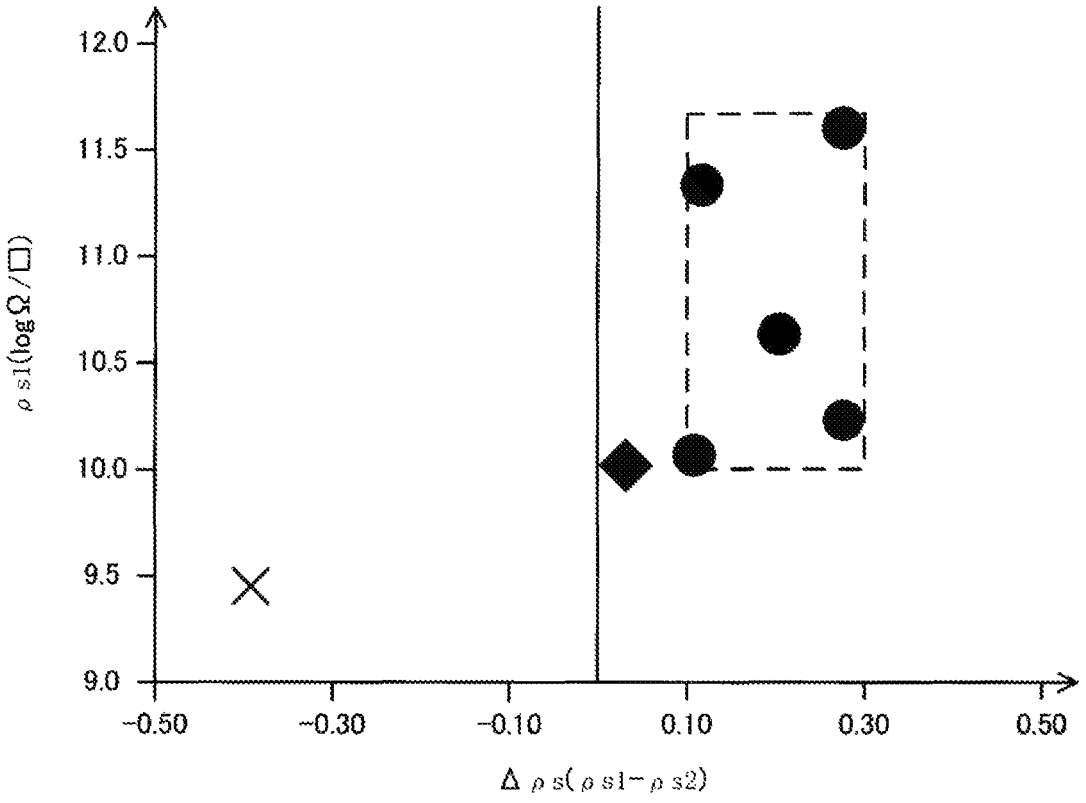
FIG. 13 is a diagram illustrating a graph indicating a relationship between the surface resistivity of the belt and difference in the surface resistivity between the inner and outer circumferential surfaces of the belt in Example 7 to 14 according to Embodiment 2.

FIG. 12 is a graph illustrating the relationship between the surface resistivity difference Δρs and the surface resistivity ρs1 in Examples 1 to 6 according to Embodiment 1. FIG. 13 is a graph illustrating the relationship between the surface resistivity difference Δρs and the surface resistivity ρs1 in Examples 7 to 14 according to Embodiment 2.

Clearly seen by comparison with FIG. 12, it is found that when the surface resistivity ρs1 of the outer circumferential surface of the belt 231 is greater than the surface resistivity ρs2 of the inner circumferential surface of the belt 231, especially when the surface resistivity difference Δρs is not less than 0.1 and not more than 0.3 (0.1≤Δρs≤0.3), there is an effect of suppressing the transfer streaks as illustrated in FIG. 13. The transfer streaks are generated by the discharge in the gap between the photosensitive drum 111 and the belt 131 or 231 or the gap between the belt 131 or 231 and the inlet or the outlet for the medium.

Further, in the belt 231 according to Embodiment 2, when the surface resistivity difference $\Delta\rho s$ is not less than 0.1 and not more than 0.3 ($0.1 \leq \Delta\rho s \leq 0.3$), the surface potential $V_0$ is not more than 20 V ($V_0$ 20 V) and the dependence a of the secondary transfer efficiency is not more than 0.1. Therefore, the belt 231 that has the characteristics of $0.1 \leq \Delta\rho s \leq 0.3$ can achieve both of the transfer streak suppression and the high secondary transfer efficiency of 90% or more.

In the belt 231, which includes the outer circumferential layer and the inner circumferential layer having resistances different from each other, it becomes difficult for a local current to flow in the thickness direction of the belt 231, in comparison with the single layered belt 131 whose conductivity is constant in the thickness direction thereof. Electrons that are entered from the outer circumferential surface of the belt 231 move toward the inner circumferential surface while the electrons disperse more in the circumferential direction (plan direction) than in the thickness direction of the belt 231 at the interface between the high resistance outer circumferential layer and the low resistance inner circumferential layer of the belt 231. Thus, it is presumed that it is difficult for a local current to flow in the thickness direction of the belt 231. That is, it is presumed that when a voltage is applied to or a discharge occurs at the outer circumferential surface of the belt 231 and thus electrons are supplied to the outer circumferential surface of the belt 231, the electrons are accumulated at the interface between the high resistance outer circumferential layer and the low resistance inner circumferential layer of the belt 231 and flows toward the circumferential direction (plan direction) along the low resistance inner circumferential layer, and thus the electrons are less likely to be accumulated on the outer circumferential surface, so as to suppress the charge on the outer circumferential surface as a result.

As indicated by the results in Embodiment 2 described above, in the case where the potential $V_0$ immediately after the application of the voltage of 6 KV to the outer circumferential surface of the belt 231 (after 0.1 seconds) becomes the voltage of 20 V or less, the current dependence a of the secondary transfer efficiency can be suppressed to 0.1 or less, and thus the secondary transfer efficiency of 90% or higher can be achieved. As a result, the belt that has such characteristics can reduce adverse effects from the printing environments, the thickness of the medium, or the uneven resistance to the secondary transfer efficiency, and to suppress the density unevenness in a page or the density difference between pages.

Further, as indicated by the results in Embodiment 2, in the case where the surface resistivity difference $\Delta\rho s$ between the outer circumferential surface and the inner circumferential surface is not less than 0.1 and not more than 0.3 ($0.1 \leq \Delta\rho s \leq 0.3$), it is possible to achieve both suppression of the current dependence of the secondary transfer efficiency with the secondary transfer efficiency of 90% or more and suppression of transfer streaks.

Note that as described above, it is generally said that a belt needs to have a surface resistivity $\rho s1$ of not less than 10.0 and not more than 11.0 ($10.0 \leq \rho s1 \leq 11.0$) in a related art. However, as illustrated in FIG. 13 regarding Embodiment 2, the belt having the surface resistivity difference $\Delta\rho s$ of not less than 0.1 and not more than 0.3 ($0.1 \leq \Delta\rho s \leq 0.3$) can prevent or effectively suppress occurrence of transfer streaks, even if the belt has the surface resistivity $\rho s1$ of more than 11.0.

Figure 14A:
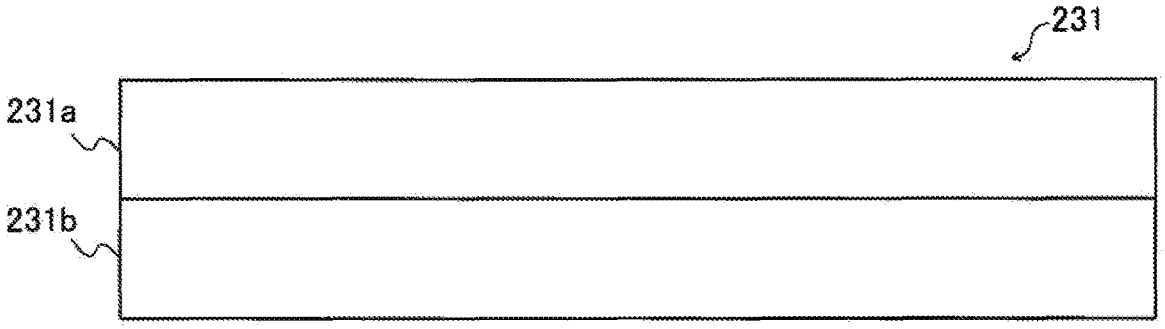
FIGS. 14A to 14D are diagrams illustrating cross sectional views of belts according to Embodiment 2 and modifications thereof.
Figure 14B:
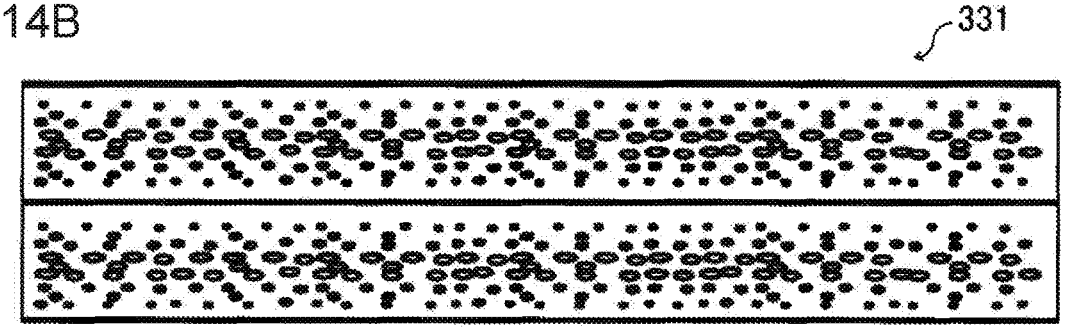
Figure 14C:
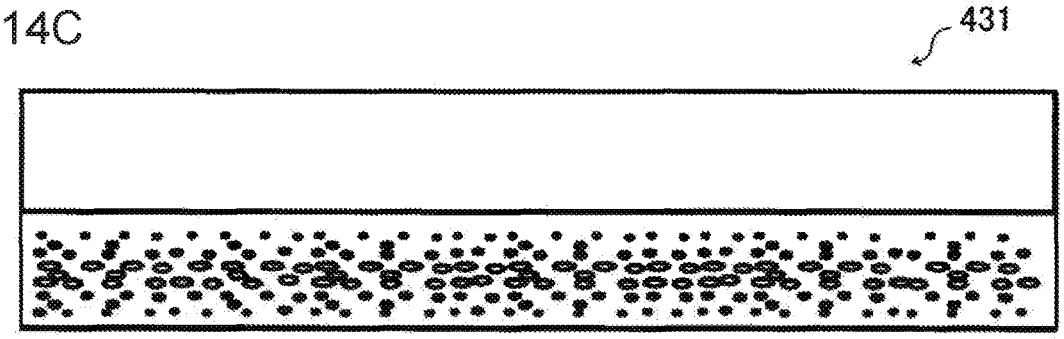
Figure 14D:
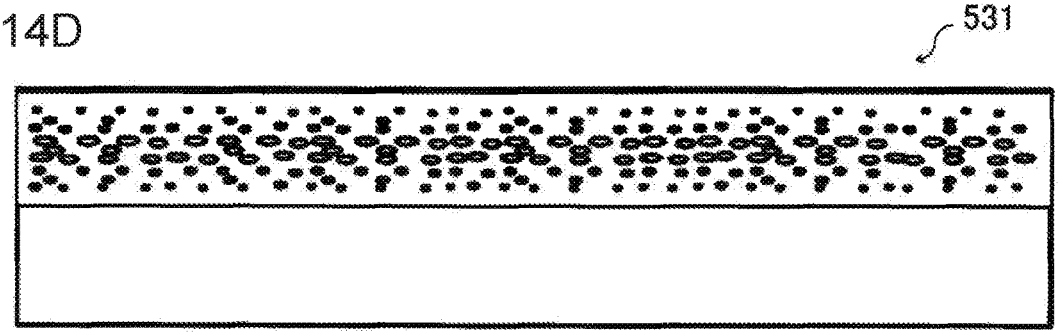

In Embodiment 2, the belt 231 is made of the two layers of resin as illustrated in FIG. 14A. However, as illustrated in FIGS. 14B to 14D, at least one of the two layers may have therein plural cavities (voids). Note that FIGS. 14A to 14D are diagrams illustrating cross sectional views of belts according to Embodiment 2 and modifications thereof.

As illustrated in FIG. 14A, the belt 231 according to Embodiment 2 includes the first layer (front surface layer) 231*a* and the second layer (rear surface layer) 231*b* which are formed of the substantially same belt materials.

Here, the belt 231 of Embodiment 2 may have plural cavities therein, like the belts 331, 431, and 531 illustrated in FIGS. 14B, 14C, and 14D. Specifically, a large number of cavities are formed in an inner portion in the thickness direction of each of the belts 331, 431, and 531.

On the other hand, in each of the belts 331, 431, and 531, a portion in the vicinity of the outer circumferential surface or the inner circumferential surface of the belt has no cavities or has cavities having smaller size than cavities in the inner portion in the thickness direction of the belt.

With such many cavities inside the belt (331, 431, or 531), the pressure applied to the developer between the photosensitive drum 111 and the belt (331, 431, or 531) can be dispersed. Accordingly, the current dependence can be reduced while preventing occurrence of an image defect such as partial omission of an image.

It is found that the belt having cavities in the cross sectional structure like the belts 331, 431, and 531 is less likely to be charged compared to the solid belt 231 having no cavities even if a high voltage is applied to the surface, and the surface potential $V_0$ thereof is small. It is thought that this is because many interfaces inside the belt (331, 431, 531) that can cancel electric charges each other due to the existence of the cavities makes the belt difficult to be charged. As a result, the surface potential $V_0$ can be effectively decreased and thus the current dependence of the secondary transfer efficiency can be effectively decreased due to the existence of the cavities as described above.

Further, because the portion in the vicinity of the surfaces of the belt (331, 431, 531) does not have the cavities, the surfaces of the belt are smooth and thus the cleaning performance on the belt by the cleaning member 142 can be maintained.

How to check for the presence of cavities in the belt (331, 431, 531) is explained below. The presence of the cavities in the belt is checked using "Electron microscope S-2380N" manufactured by Hitachi, Ltd., which is a scanning electron microscope (SEM) capable of measuring the sizes of the cavities. Carbon deposition is performed for 60 seconds on a cut cross section of the belt (331, 431, 531), and then the cut cross section is observed using the SEM at 3000 times magnification with the acceleration voltage of 15 KV. The inventor confirms the existence of cavities within unit area (10 μm×10 μm) at the positions of 10 μm and 70 μm in depth from the outer circumferential surface in the cut cross section of the belt (having the thickness of 80 μm) observed through the SEM.

The above described belts 131, 231, 331, 431, and 531 are described as an intermediate transfer belt. However, Embodiments 1 and 2 are not limited to this. For example, the belts described in Embodiments 1 and 2 may be used as a conveyance belt that conveys a medium to the image formation unit 110.

The invention includes other embodiments and modifications in addition to the above-described embodiments and modifications without departing from the spirit of the invention. The embodiments and modifications are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A belt unit comprising:

an endless belt including a first layer having a first surface and a second layer having a second surface on an opposite side across the belt from the first surface in a thickness direction of the belt; and a drive roller in contact with the second surface and configured to drive the endless belt, wherein a first surface resistivity of the first layer ρs1 and a second surface resistivity of the second layer ρs2 satisfy the expressions (1) and (2):

$$9.4 \log \Omega/\square \leq \rho s1 \leq 11.6 \log \Omega/\square \quad (1); \text{ and}$$

$$9.8 \log \Omega/\square \leq \rho s2 \leq 11.3 \log \Omega/\square \quad (2).$$

2. The belt unit according to claim 1, wherein the first layer and the second layer are substantially the same resin.

3. The belt unit according to claim 1, wherein the first layer comprises a first resin, and the second layer comprises a second resin different from the first resin.

4. The belt unit according to claim 1, wherein the first surface resistivity of the first layer is not less than the second surface resistivity of the second layer.

5. The belt unit according to claim 1, wherein a difference Δρs between the first surface resistivity of the first layer and the second surface resistivity of the second layer satisfies the following equation (3):

$$0.1 \leq \Delta \rho s \leq 0.3 \quad (3).$$

6. The belt unit according to claim 1, wherein the thickness of the first layer is not less than 30 μm and not more than 80 μm, and the thickness of the second layer is not less than 30 μm and not more than 50 μm.

7. The belt unit according to claim 1, wherein at least one of the first layer and the second layer includes therein a plurality of cavities.

8. The belt unit according to claim 1, wherein the thickness of the belt is not less than 60 μm and not more than 130 μm.

9. The belt unit according to claim 1, wherein the first surface is an outer circumferential surface of the belt and the second surface is an inner circumferential surface of the belt.

10. The belt unit according to claim 1, wherein the belt comprises an intermediate transfer belt to which a developer image is to be transferred from an image formation unit.

11. The belt unit according to claim 1, wherein the belt comprises a conveyance belt that conveys a medium thereon to which a developer image is to be transferred from an image formation unit.

12. An image formation apparatus comprising the belt unit according to claim 1.

13. An image formation apparatus comprising:

an image formation unit that forms a developer image; and the belt unit according to claim 1, such that the developer image is to be transferred from the image formation unit to the belt of the belt unit.

14. An image formation apparatus comprising:

an image formation unit that forms a developer image; and the belt unit according to claim 1, such that the belt of the belt unit is configured to convey a medium thereon to which the developer image is to be transferred from the image formation unit.

15. The belt unit according to claim 1, wherein the belt comprises a plurality of cavities at an inner portion of the belt in the thickness direction of the belt, and sizes of the plurality of cavities decrease as closer to the first surface or the second surface in the thickness direction from a certain depth in the thickness direction.

16. The belt unit according to claim 15, further comprising an interface between the first layer and the second layer.

* * * * *